United States Patent [19]

Gerdes et al.

[11] Patent Number: 4,644,698

[45] Date of Patent: Feb. 24, 1987

[54] REFRIGERATOR AND METHOD OF GASKET ASSEMBLY CONSTRUCTION

[75] Inventors: Keith W. Gerdes; Douglas E. Corts; Thomas E. Jenkins; Stephen C. Lesmeister; Louis A. Welle, Sr., all of Louisville, Ky.

[73] Assignee: General Electric Company, Louisville, Ky.

[21] Appl. No.: 869,589

[22] Filed: Jun. 2, 1986

[51] Int. Cl.[4] ..... E06B 7/16

[52] U.S. Cl. ..... 49/478; 49/485; 49/489; 49/490; 49/493; 312/296

[58] Field of Search ..... 49/493, 478, 492, 485, 49/486, 487; 312/296

[56] References Cited

U.S. PATENT DOCUMENTS

| | | | |
|---|---|---|---|
| 1,705,455 | 3/1929 | Griffiths | 49/492 |
| 2,049,501 | 8/1936 | Herron | 155/184 |
| 2,271,495 | 1/1942 | Hall | 24/73 |
| 3,126,590 | 3/1964 | Monti | 20/69 |
| 3,226,367 | 12/1965 | Monti | 20/69 |
| 3,242,537 | 3/1966 | Monti | 20/69 |
| 3,289,352 | 12/1966 | Heilweil et al. | 49/485 |
| 3,378,957 | 4/1968 | Frehse | 49/487 |
| 3,400,964 | 9/1968 | Baermann | 49/478 X |
| 3,411,243 | 11/1968 | Baermann | 49/478 |
| 4,305,230 | 12/1981 | Gerritsen | 49/487 |
| 4,306,379 | 12/1981 | Linstromberg | 49/486 |
| 4,469,383 | 9/1984 | Losert | 49/478 |

*Primary Examiner*—Kenneth Downey
*Attorney, Agent, or Firm*—Frederick P. Weidner; Radford M. Reams

[57] ABSTRACT

A refrigerator having an outer case, an inner liner with thermal insulation therebetween, and a storage compartment having an access opening surrounded by a face portion of magnetic material. A door is hingedly mounted on said cabinet for closing and opening said access opening. The door comprises an outer panel and an inner panel with a peripheral edge portion and terminal end, said panels having thermal insulation therebetween. Elongated channel member sections having top, bottom and side walls are located adjacent the peripheral edges of the door on all four sides and have spaced screw openings in the bottom and top walls with the screw openings in the bottom wall being countersunk. An open slot in the top wall interconnects the screw openings along the length of the channel member sections. The channel member sections overlie the peripheral edge portion and terminal end of the door inner panel and are secured to the door by screws having a threaded body and countersink head by passing the threaded body of the screws through the peripheral edge portion and the inwardly turned flange of the outer metal panel. A sealing gasket is made of resilient material and is removably mounted on the elongated metal channel member sections and includes in lateral cross-section a base portion with a downwardly projecting winged dart having a body and two diverging arms projecting through the open slot in the top wall of the channel member sections and overlying the screws securing the channel member sections to the door. The sealing gasket also has a cabinet engaging portion and includes a magnet to be attracted to the area of magnetic material and provides the sole means for holding the door in a closed position.

19 Claims, 13 Drawing Figures

FIG. 5
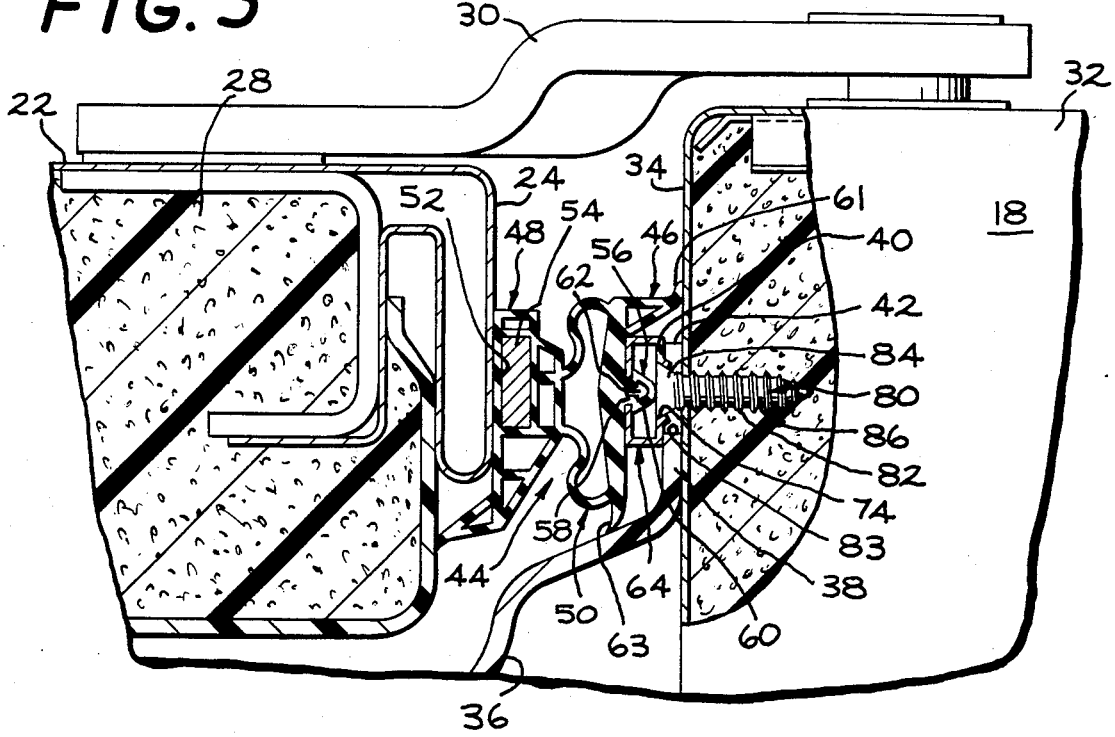
FIG. 6
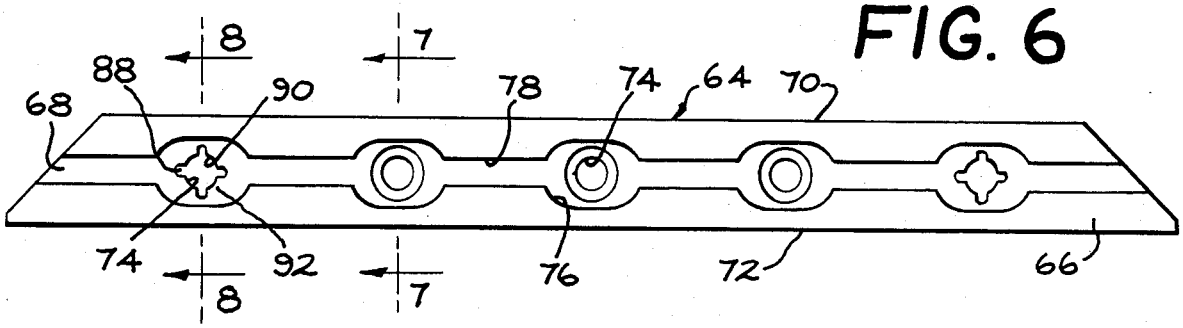
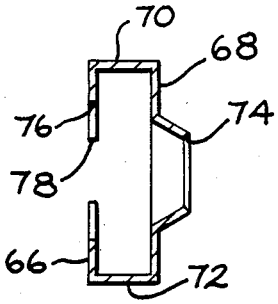
FIG. 7
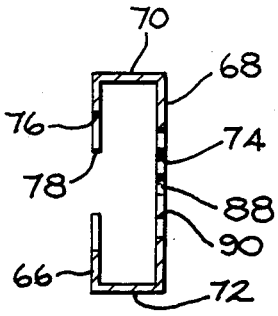
FIG. 8

REFRIGERATOR AND METHOD OF GASKET ASSEMBLY CONSTRUCTION

BACKGROUND OF THE INVENTION

The present invention relates to a refrigerator and more particularly to a gasket assembly and method of construction.

A well known type of gasket assembly is shown and described in U.S. Pat. Nos. 4,469,383 and 3,359,053 assigned to the same assignee as the present invention. In those patents there is described a gasket of extruded resilient material such as rubber, polyvinyl chloride, or the like and the flexibility or resilience of various portions of the gasket is controlled by varying the cross-sectional thicknesses thereof in order that each portion may perform the desired function or functions. For example, the base portion, which is secured along its outer edge to the door assembly, must be sufficiently thick and rigid so that its inner free edge is normally in engagement with the door surface and maintains an insulating dead air space beneath the gasket portion when the door is in a closed position. However, the gasket must also be sufficiently flexible so that it can be folded back upon itself during assembly of the door and gasket to provide access to the fastening or anchoring means employed to secure the one edge of the gasket to the door. The securement of the gasket to the door is by means of a long retainer strip made of metal through which fastening screws will pass and anchors the retainer strip to the door with one portion of the retainer strip gripping the rigid portion of the gasket to hold it in its proper position and the flexible portion acting as a seal against the face of the cabinet. With such a prior art gasket assembly special skills and sometimes a lot of rework is required to overcome the inherent gasket mounting problems to make certain that the gasket is properly positioned on the cabinet door to assure good sealing characteristics. As is often the case, the gasket is pinched causing the thin outer edge of the gasket to be distorted. In addition, there is a tendency for the gasket to roll, causing the front edge to be turned under when the fasteners are tightened. The gasket also has a tendency to be caught between the inner door and the retainer, resulting in gasket distortion. The assembly of this type of gasket assembly has high labor content because it is required that a portion of the gasket be manually pulled out of the way so that screw fasteners can be driven into the door to hold the retainer strips and gasket in place.

By this invention, there is provided a refrigerator and method of constructing the gasket assembly thereof which includes allowing the screw driving system to be automated if desired, which reduces the labor cost of manufacture that also provides no gasket distortion during installation and no bunching up to the gasket due to over-stretching during installation. It also provides even retention at the interface between the door and the edge of the gasket and in addition provides for ease of replacement of the gasket should it become defective and need replaced.

SUMMARY OF THE INVENTION

A refrigerator with a cabinet having an outer case, an inner liner with thermal insulation therebetween, and method of constructing a gasket assembly therefor, which cabinet includes a storage compartment having an access opening surrounded by a face portion comprising an area composed of magnetic material. A door is hingedly mounted on the cabinet along one edge thereof for closing the access opening, said door comprising an outer metal panel having an inwardly turned flange extending about the periphery thereof and an inner panel having a flange with a peripheral edge portion and terminal end overlying the metal panel flange. Elongated channel member sections having top, bottom, and side walls are secured to the door adjacent the peripheral edges and have spaced screw openings in the bottom and top walls, said screw openings in the bottom wall being countersunk, and the top wall has an open slot interconnecting the screw openings along the length thereof. Each of the channel member sections overlie the peripheral edge portion and terminal end of the inner panel when it is secured to the door by screws having a threaded body and countersink head by passing the threaded body of the screws through the peripheral edge portion and the inwardly turned flange of the outer metal panel. A sealing gasket of resilient material is removably mounted on the elongated metal channel member sections and includes a base portion with a downwardly projecting winged dart having a body and two diverging arms projecting through the open slot in the top wall of the channel member sections and overlying the screws securing the channel member sections to the door. The sealing gasket also has a cabinet engaging portion integrally joined to the base portion and including a magnetic means attached to said area of magnetic material and provides the sole means for holding the door in a closed position.

BRIEF DESCRIPTION OF THE DRAWINGS

FIG. 5 is an enlarged view of the gasket assembly of the present invention similar to that shown in FIG. 4.

FIG. 6 is a top plan view of a portion of the gasket assembly of the present invention.

FIG. 7 is a cross-sectional view taken along line 7—7 of FIG. 6.

FIG. 8 is a cross-sectional view taken along line 8—8 of FIG. 6.

DESCRIPTION OF THE PREFERRED EMBODIMENT

Figure 1:
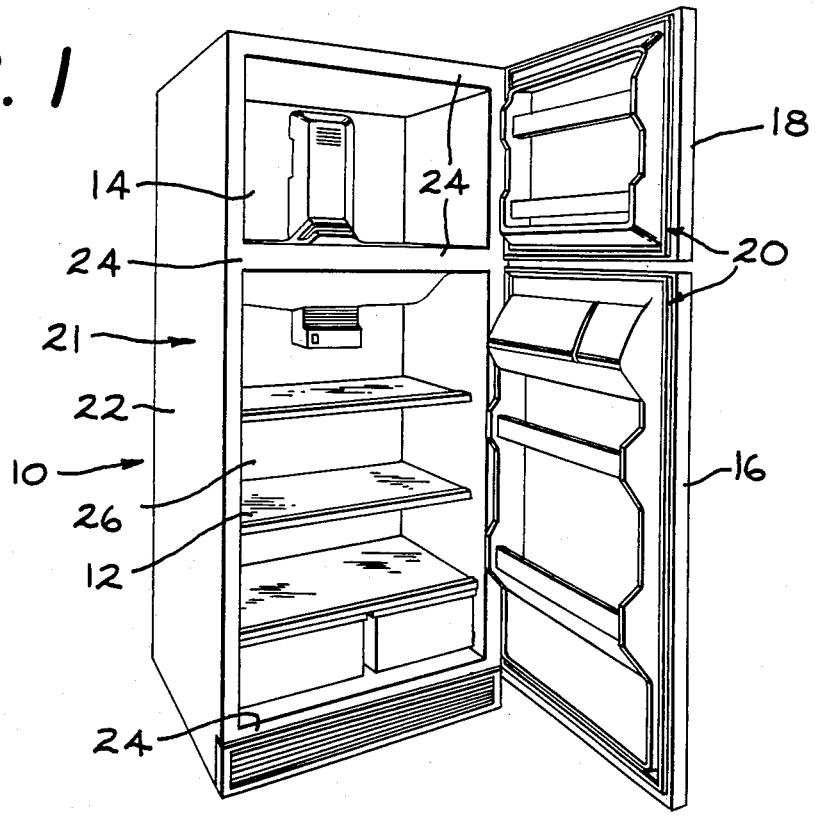
FIG. 1 is a perspective view of a refrigerator with the access doors open.

With reference to FIG. 1, there is shown a household refrigerator 10 having a fresh food compartment 12 and a freezer compartment 14 which have their access openings closed by doors 16 and 18 respectively. Each of the doors 16 and 18 have a gasket assembly 20 which are around the peripheral edges of each of the respective doors.

FIGS. 2–5 in particular show the gasket assembly of the present invention. The refrigerator has a cabinet 21 which comprises an outer metal panel 22 surrounded by a face portion 24 comprising an area composed of magnetic material such as steel. The cabinet has an inner liner 26 usually made from plastic material which is joined to the outer metal case 22 and there is thermal insulation 28 between the outer metal case 22 and inner liner 26. The door, such as freezer door 18, is mounted on the cabinet outer case 22 by hinges 30 along one edge of the cabinet so that the door may be opened and closed. The door comprises an outer metal panel 32 having an inwardly turned flange 34 extending about the periphery of the door. There is an inner panel 36 usually made of plastic material having a flange 38 with a peripheral edge portion 40 and terminal end 42 overlying the metal panel flange 34.

The gasket assembly includes a gasket 44 comprising a resilient material such as rubber, polyvinyl chloride or the like and includes as viewed in lateral cross-section a base portion generally indicated as 46 and a cabinet engaging portion generally indicated as 48 with an intermediate bellows type flexible portion 50 interconnecting the base portion 46 and cabinet engaging portion 48. The cabinet engaging portion 48 has a cavity 52 which contains a strip of magnetic material 54 which when the door is closed will be attracted to the magnetic material in the face portion of the cabinet and is the sole means for maintaining the door in a closed position.

The base portion 46 of the gasket has a downwardly projecting winged dart 56 having a body 58 and two diverging arms 60 and the center of the winged dart 56 has a hollow cavity 62. The base portion 46 also has a lip seal 61 that seals against the inwardly turned flange 34 and a lip seal 63 that seals against the inner panel 36 of the door.

Figure 2:
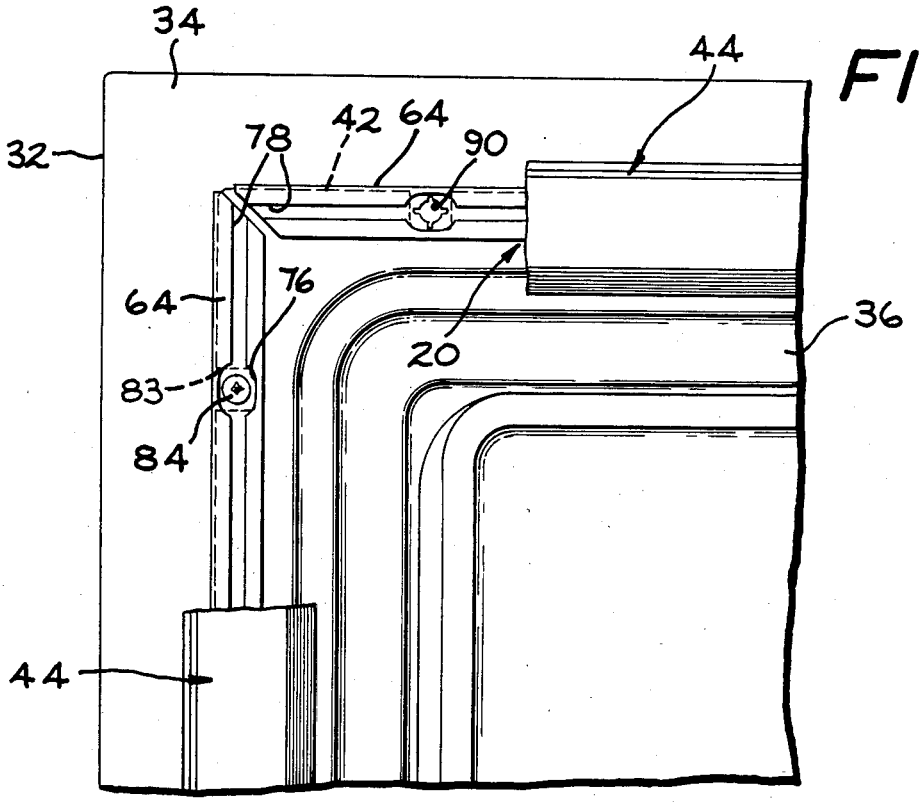
FIG. 2 is a partial view of the refrigerator door and gasket assembly with parts broken away showing the present invention.
Figure 3:
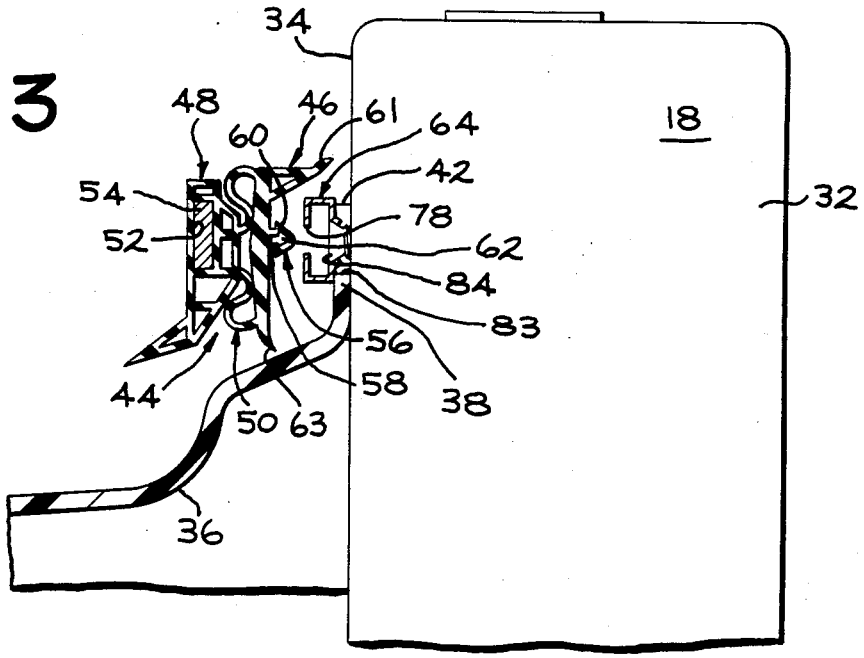
FIG. 3 is a lateral cross-sectional view through a portion of a refrigerator door embodying the gasket assembly of the present invention and showing partial assembly of the gasket assembly to the door.
Figure 4:
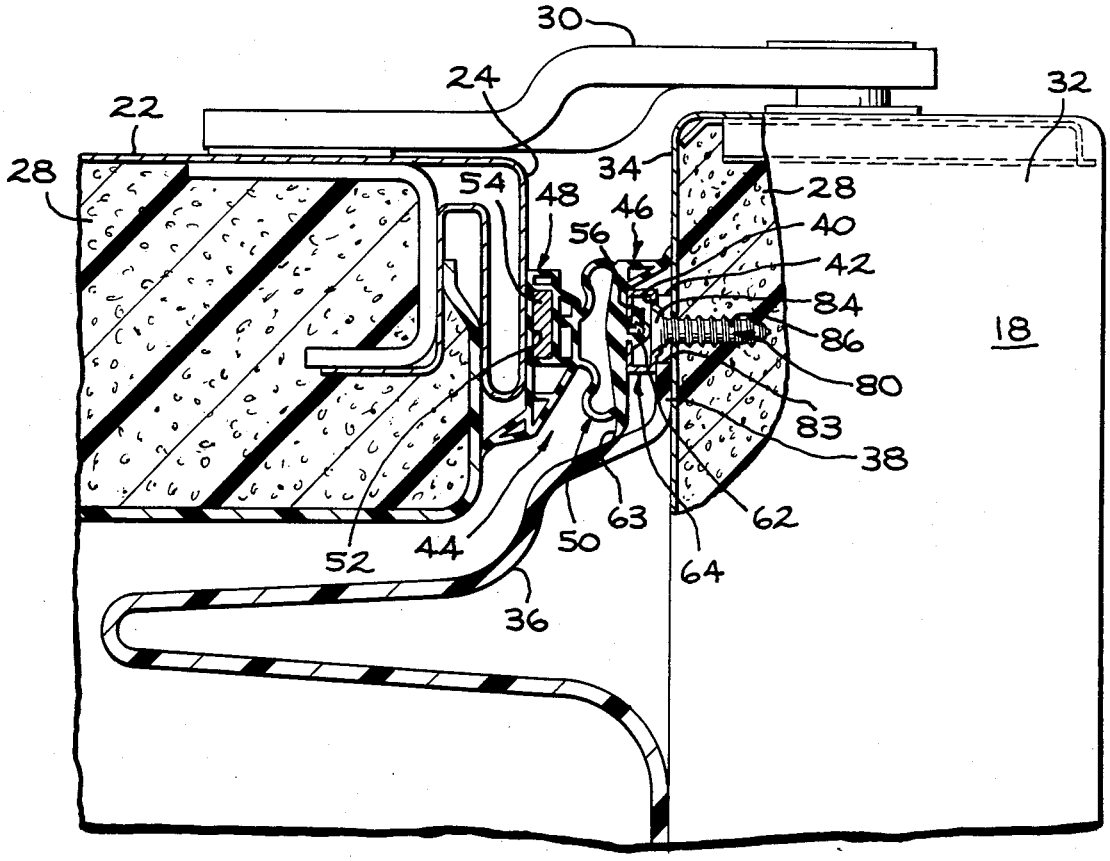
FIG. 4 is a lateral cross-sectional view through a portion of a refrigerator door showing the gasket assembly of the present invention in its fully assembled condition.
Figure 13:
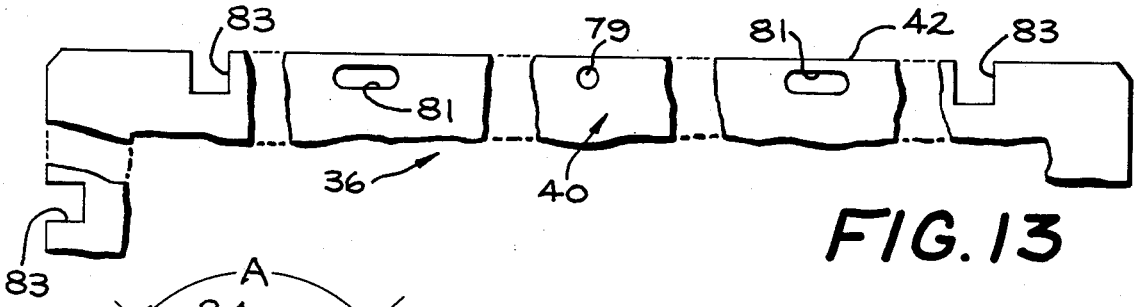
FIG. 13 is a top plan view of a portion of the door inner panel used in the gasket assembly of the present invention.
Figure 10:
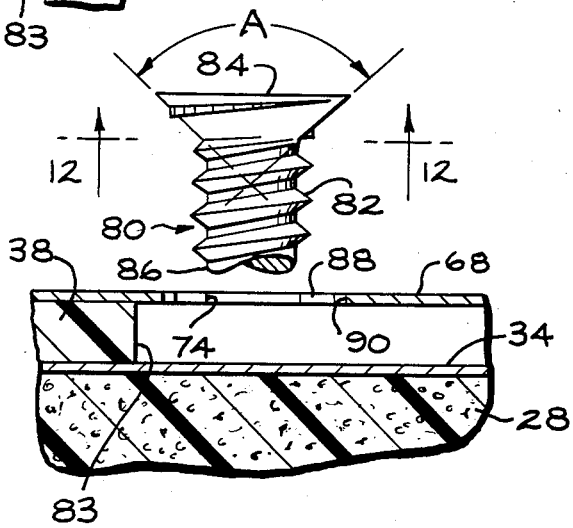
FIG. 10 is a side elevational view of a portion of the gasket assembly of the present invention.
Figure 11:
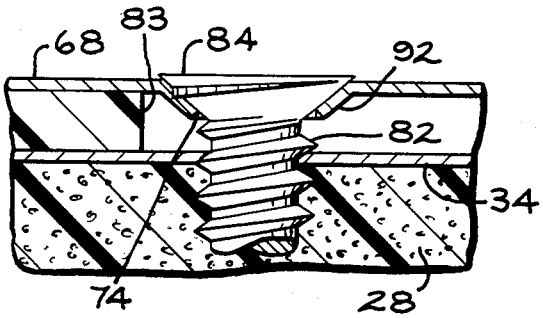
FIG. 11 is a side elevational view of a portion of the gasket assembly of the present invention.

The gasket assembly 20 includes elongated channel member sections 64, each having a top wall 66, a bottom wall 68, and side walls 70 and 72. The elongated channel member sections 64 may be mitered at each end, one of which is shown in FIG. 6 and are formed into a picture frame like configuration and fastened near all four sides of the door adjacent the peripheral edges thereof such as shown in FIGS. 1 and 2. The channel member sections 64 have spaced screw openings 74 in the bottom wall and also spaced screw opening 76 in the top wall. The screw openings 74 in the bottom wall after final assembly are all countersunk as shown particularly in FIGS. 3–5. The top wall 66 of the channel member sections has an open slot 78 interconnecting the screw opening 76 along the length of the channel member sections. The channel member sections are placed on the door 18 such that it overlies the peripheral edge portion 40 and terminal end 42 of the inner panel 36. The inner panel 36 is made of thin plastic material as by vacuum forming and has openings 79 in the peripheral edge portion 40 to accommodate the countersunk screw openings 74. The channel member sections are secured by self-threading screws 80 having a threaded body 82 and countersink head 84 by passing the threaded body 82 of the screws through the openings in the peripheral edge portion 40 and screwed into the inwardly turned flange 34 of the metal panel and the insulation 28, as shown in FIG. 4. With reference to FIG. 13, a length of the peripheral edge portion 40 and terminal end 42 of one side of the inner panel 36 is shown. In the middle of the length of peripheral edge portion 40 is a round opening 79, then on each side of the round opening are elipse shaped openings 81 and near the ends of the length of the peripheral edge portion 40 are open ended slots or notches 83. In the construction of the refrigerator the channel member section 64 is first secured by a screw through a preformed countersink screw opening 74 which protrudes downwardly into the round opening 79 as this aligns the channel member section with a pre-drilled inner panel 36, and the pre-drilled inwardly turned flange 34 to properly align all three components. Next screws are placed through each of the elipse openings 81 and the preformed countersink openings 74 in the channel member sections moves the inner panel relative to the outer panel for correct alignment before the screws are tightened completely. For this purpose, the minor axis diameter of the elipses is slightly larger than the preformed countersink of the channel member section. Next the screws at the ends of the channel member section are placed through the notches 83 in the inner panel 36 and tightened. As will be explained more fully later, these end screws cooperate with the channel member section and the inwardly turned flange 34 to very tightly clamp the inner panel 36 between them. For this reason, notches 83 in the inner panel 36 are utilized so the clamping force does not fracture the peripheral edge portion 40, which as mentioned above is made of thin plastic material.

Figure 9:
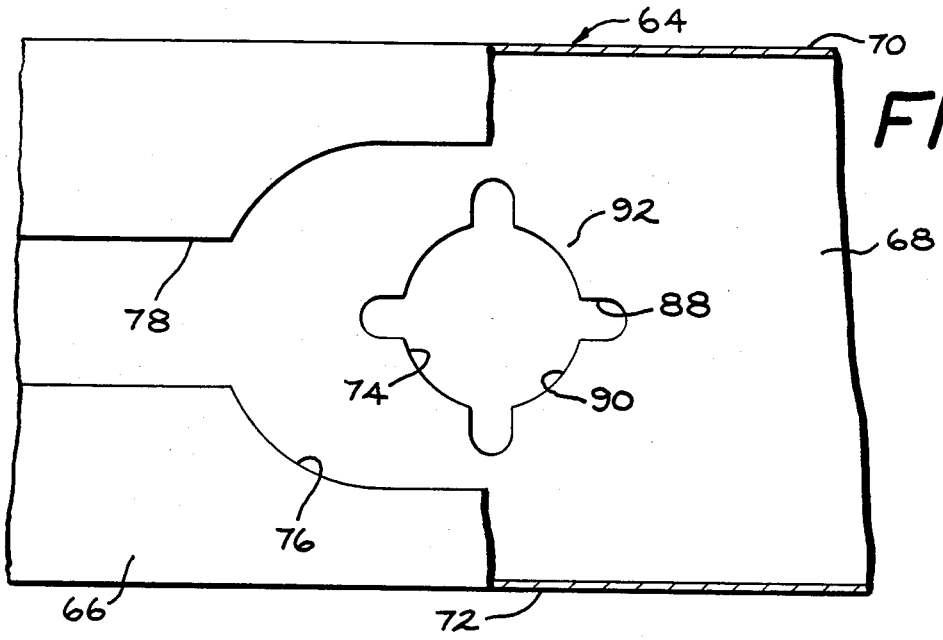
FIG. 9 is a top plan view of a portion of the gasket assembly of the present invention.
Figure 12:
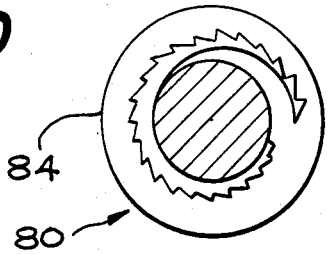
FIG. 12 is a view of the screw shown in FIG. 10 and taken along line 12—12 of that figure.

As can be understood, the channel member sections are used on refrigerator doors to hold the door gasket in place and also to clamp the plastic inner door panel 36 to the inwardly turned flange 34 of the door outer metal panel by utilizing self-threading sheet metal screws. The refrigerator doors in which this gasket assembly construction is utilized has an outer metal panel thickness of around 0.024 inches. The doors inner panel 36 has a peripheral edge portion 40 thickness of about 0.040 inches but will vary in thickness from one side to another slightly due to vacuum forming practices. The differential between screw-torque required to provide adequate clamp force on the inner panel of the door and strip torque in the sheet metal of the outer panel of the door is very small. As part of this invention, it has been found that this differential can be significantly increased by providing a countersink around the screw opening in the channel member sections and using a special screw having a friction-generating characteristic on the underside of the head which acts against the surface area created by the countersink to provide a torque-brake. The problem arises from the difficulty associated with generation of the countersink in the type process normally used to produce parts having a channel member in cross-section such as channel member sections 64. To overcome this problem there has been devised a modified screw clearance opening which enables the screw head to form the countersink as the screw is driven into the door. With reference particularly to FIGS. 9–12, there is shown in FIG. 9 a top plan view of the screw opening 74 in the bottom wall 68 at each end of the channel member sections 64. The screw opening 74 has a diameter substantially equal to the diameter of the shank portion 86 of the screw 80 and has extending radially outward from the screw opening lances or cut-out portions 88 with tab sections 92 therebetween. As shown in FIG. 9 in the preferred embodiment, there are four cut-out portions 88 and four tab sections 92 spaced equidistance around the opening 74. The radially extending cut-out portions extend from the periphery 90 of the screw opening 74 a distance approximately the difference between half the diameter of the screw shank 86 and half the diameter of the screw head 84. This is shown particularly in FIG. 11. In operation then while the channel member sections are being formed preferably of metal the screw openings 74 at each end of the channel member section are formed in the bottom wall 68 and lances or cut-out portions are provided around the periphery 90 of the opening as described above, then the threaded body 82 of the screw is passed through the screw opening 74 and upon driving the screw into the door the countersink of the screw head 84 engages tabs 92 and force or bend the tabs 92 downwardly to the position shown in FIG. 11. As the screw head contacts the tabs 92, they are bent to conform to the underside of the screw head to provide the needed surface area which acts as a torque brake. To enhance the screw head countersink to act as a torque brake the screws should have an included angle "A" (FIG. 10) on the underside of the screw head of about 100°. The tendency of the metal tabs 92 to spring back also adds resistance to the screw. In addition, the countersink surface may have a number of raised embossments projecting from the surface of the countersink and arranged in a spiral starting at the base of the countersink and approaching the upper edge of the countersink (FIG. 12). These embossments will dig into the material of the tab sections 92 or the preformed countersink of openings 74, thus increasing the frictional engagement between the screw and channel member section. Increasing the frictional engagement between the screw and channel member section is important so that the screws may be driven by conventional automatic pneumatic screw drivers which will stop driving the screw before it is stripped from engagement with the inwardly turned flange 34, which as mentioned previously is thin gage metal (approximately 0.024 inches). To accomplish this, the torque brake force between the screw head and metal tabs forming the countersink or the preformed countersink of openings 74 must be great enough to allow the automatic screw driver to stop driving the screw at a preset force value prior to reaching a force that would strip the screw from the flange 34.

In the preferred embodiment of the present invention it has been found that a combination of both preformed countersink openings 74 in the bottom wall of the channel member and also the screw formed countersink arrangement as described above is desirable. In particular, it is desirable to have the screw formed countersink openings located only at each end of each of the channel member sections as shown in FIG. 6. The screw openings 74 intermediate the two end openings formed by the countersink screw are preformed as a countersink as shown in FIG. 7 in the bottom wall of the channel member sections. The reason for this configuration is that the preformed screw openings such as shown in FIG. 7 provide excellent alignment capability of the gasket assembly to the inner panel 36 of the door along the length of the channel member section. On the other hand, the screw formed countersink openings at each end of each of the channel member sections provides excellent clamping of the inner door panel 36 to the outer door panel 32. Therefore, the combination of the two types of countersink screw openings uses the best features of each to provide low labor and good alignment capabilities of all components in the assembly where alignment is critical and strong clamping securement at the ends of channel member sections where it is needed.

After the channel member sections have been secured to the door as described above and thereby providing a picture frame like structure around the periphery of the door, the gasket 44 is secured to the channel member sections by inserting the winged dart 56 through the slot 78 in the top wall 66 of the channel member sections. The gasket is a continuous rectangle in shape, that is, it's like a four sided picure frame with the corners being mitered and joined together. It will be noted in FIG. 2 that mitered ends of the channel member sections have a space 94 between each other and this space helps accommodate the mitered corner configuration of the gasket 44. The snapping in of the gasket to the channel member sections may be easily accomplished because the hollow cavity 62 allows the body 58 and diverging arm 60 to be slighly collapsed and pass through the slot opening until the diverging arms are within the channel member sections whereupon the elastic material reforms to the shape shown in FIGS. 4 and 5. It will be noted that the body 58 of the winged dart 56 spans the distance between the edges of the slot 78 and that the diverging wings extend outwardly of the edges of the open slot 78 to be retained by the underside of the top wall 66 of the channel member sections. Also, as can be seen in FIGS. 4 and 5, the dimensions of the winged dart 56 and the channel member depth are such that the winged dart usually engages or abuts the screw heads 84. With this kind of gasket assembly arrangement, it will be understood that the labor content involved with attaching a gasket to a refrigerator door is greatly reduced and further allows the use of automatic screw drivers if desired. In this gasket assembly arrangement then there is provided lower labor cost, no gasket distortion during installation, no bunching up of the gasket due to over-stretching during installation, even retention at the interface between the door and gasket edge, and good alignment between the gasket assembly, inner door panel and outer door panel. Such was not the case with gasket assemblies utilizing a gasket retainer strip which had one portion screwed into the door and the other portion clamping the gasket to the door which gasket had to be folded back upon itself to gain access to the screws. Moreover, should the gasket 44 need to be replaced due to some defect the gasket may simply be pulled out of the channel member around the periphery of the door and a new gasket snaped in place.

While, in accordance with the patent statute, there has been described what at present is considered to be the preferred embodiment of the invention, it will be obvious to those skilled in the art that various changes and modifications may be made thereto without departing from the invention. It is, therefore, intended by the appended claims to cover all such changes and modifications as fall within the true spirit and scope of the invention.

What is claimed is:

1. A refrigerator comprising:

a cabinet having an outer case, an inner liner with thermal insulation therebetween, and a storage compartment having an access opening surrounded by a face portion comprising an area composed of magnetic material;

a door hingedly mounted on said cabinet along one edge thereof for closing said access opening, said door comprising an outer metal panel having an inwardly turned flange extending about the periphery thereof and an inner panel having a flange with a peripheral edge portion and terminal end overlying said metal panel flange;

elongated channel member sections having top, bottom and side walls adjacent the peripheral edges of the door and having spaced screw openings in the bottom and top walls, said screw openings in the bottom wall are countersunk and an open slot in the top wall interconnecting the screw openings along the length thereof, said channel member sections overlying the peripheral edge portion and terminal end of the inner panel and secured thereto by screws having a threaded body and countersink head and passing the threaded body of the screws through the peripheral edge portion and the inwardly turned flange of the outer metal panel; and a sealing gasket of resilient material mounted on said elongated metal channel member sections including in lateral cross-section a base portion with a downwardly projecting winged dart having a body and two diverging arms projecting through the open slot in the top wall of the channel member sections and overlying the screws securing the channel member to the door and removably retained in said channel member sections, and a cabinet engaging portion integrally joined to the base portion and including a magnetic means attached to said area of magnetic material and providing the sole means for holding the door in a closed position.

2. The refrigerator of claim 1 wherein the winged dart body is hollow and spans the slot of the channel member sections.

3. The refrigerator cabinet of claim 1 wherein the elongated channel member sections are rectangular in lateral cross-section.

4. The refrigerator of claim 1 wherein the winged dart extends downwardly within the elongated channel member sections and abuts the heads of the screws.

5. The refrigerator of claim 1 wherein the base of the gasket has a lip seal against the inwardly turned flange of the outer metal panel and a lip seal against the inner panel.

6. The refrigerator of claim 1 wherein the elongated channel member sections are mitered at each end thereof.

7. The refrigerator of claim 6 wherein the mitered ends of channel member sections are spaced from each other.

8. The refrigerator of claim 1 wherein the sealing gasket is a continuous rectangle in shape.

9. The refrigerator of claim 1 wherein the underside of the countersink screw head has an included angle of about 100°.

10. The refrigerator of claim 1 wherein the underside of the countersink screw head has a number of raised embossments projecting therefrom.

11. A method of constructing a gasket assembly for a refrigerator having a cabinet with a storage compartment with an access opening surrounded by a face portion comprising an area composed of magnetic material and a door hingedly mounted on the cabinet along one edge thereof for closing the access opening, said door having an outer metal panel with an inwardly turned flange extending about the periphery thereof and an inner panel having a flange with a peripheral edge portion and terminal end overlying the metal panel flange comprising:

forming elongated metal channel member sections having top, bottom and side walls and having spaced screw openings in the bottom and top walls thereof, said screw openings in the bottom wall being formed by countersinking and an open slot in the top wall interconnecting the screw openings along the length thereof;

positioning the channel member sections overlying the peripheral edge portion and terminal end of the inner panel adjacent the peripheral edges of the door;

securing by screws having a threaded body and a countersink head the channel member sections to the door by passing the threaded body of the screws through the peripheral edge portion and the inwardly turned flange of the outer metal panel;

forming a sealing gasket of resilient material, said gasket in lateral cross-section having a base portion with a downwardly projecting winged dart having a body and diverging arms and a cabinet engaging portion integrally joined to the base portion and including a magnetic means for attraction to said area of magnetic material on the face portion of the storage compartment; and forcing the downwardly projecting winged dart of the sealing gasket through the open slot in the top wall of the channel member sections so that the divering arms are within the channel member and is removably retained thereby in said channel member.

12. A method of constructing a gasket assembly in accordance with claim 11 wherein the screw openings at each end of each channel member section is an opening having radially outward cut-out portions to form bendable tabs therebetween and the securing of the elongated channel member sections to the door is by the countersink screws bending the tabs downwardly to form a countersink opening as a result of the countersink head configuration when the screw is driven into the door.

13. A method of constructing a gakset assembly in accordance with claim 12 wherein the screw openings intermediate the two end openings are formed as a countersink during the forming of the channel member sections.

14. A method of constructing a gasket assembly in accordance with claim 11 wherein the elongated metal channel member sections are mitered at each end thereof prior to securing them to the door.

15. A method of constructing a gasket assembly in accordance with claim 14 wherein positioning of the channel member sections adjacent the peripheral edges of the door is by spacing the mitered ends from each adjacent channel member section mitered end.

16. A method of constructing a gasket assembly in accordance with claim 11 wherein the sealing gasket is formed as a continuous rectangle and shaped with the four corners mitered and joined together.

17. A method of constructing a gasket assembly in accordance with claim 11 wherein a length of the peripheral edge portion of the inner panel has a round opening near the center, elipse shaped openings on each side of the round opening and notches near the ends of the length of the peripheral edge portion and the securing of the channel member sections to the door is by a screw first through the round opening, then screws through the elipse opening and then screws through the notches.

18. A method of constructing a gasket assembly in accordance with claim 11 wherein the underside of the countersink screw head has been formed with an included angle of about 100°.

19. A method of constructing a gasket assembly in accordance with claim 11 wherein the underside of the countersink screw head has been formed with a number of raised embossments projecting therefrom.

* * * * *